US010184713B2

(12) United States Patent
Schenk et al.

(10) Patent No.: US 10,184,713 B2
(45) Date of Patent: Jan. 22, 2019

(54) EVAPORATOR SHIELDS

(71) Applicant: Electrolux Home Products, Inc., Charlotte, NC (US)

(72) Inventors: Dennis Schenk, Anderson, SC (US); Fahad Vora, Anderson, SC (US); William Lee Moody, Anderson, SC (US); Edmund Richardson, Anderson, SC (US); Jonathan Ulsaker, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 367 days.

(21) Appl. No.: 14/988,851

(22) Filed: Jan. 6, 2016

(65) Prior Publication Data

US 2017/0191729 A1 Jul. 6, 2017

(51) Int. Cl.
*F25D 17/06* (2006.01)
*F25D 21/04* (2006.01)

(52) U.S. Cl.
CPC ..... *F25D 17/067* (2013.01); *F25D 21/04* (2013.01); *F25D 2317/063* (2013.01); *F25D 2400/02* (2013.01)

(58) Field of Classification Search
CPC ..... F25D 2317/0667; F25D 2317/0663; F25D 2317/036; F25D 17/067; F25D 21/01; F25D 21/14; F25D 2321/1441; F25D 2317/0671; F25D 2321/142
See application file for complete search history.

(56) References Cited

U.S. PATENT DOCUMENTS

| | | | | |
|---|---|---|---|---|
| 2,750,759 | A | 7/1952 | Harle | |
| 5,678,416 | A | 10/1997 | Yoo et al. | |
| 5,816,054 | A | 10/1998 | Yoo et al. | |
| 7,089,755 | B2 | 8/2006 | Schmid et al. | |
| 8,443,618 | B2 | 5/2013 | Friedmann et al. | |
| 2008/0196866 | A1* | 8/2008 | Wu | F25B 39/022 165/104.31 |
| 2011/0126569 | A1 | 6/2011 | Selin et al. | |
| 2011/0126570 | A1 | 6/2011 | Andersson et al. | |

(Continued)

FOREIGN PATENT DOCUMENTS

| | | |
|---|---|---|
| EP | 2520882 | 7/2012 |
| WO | 2008/080203 | 7/2008 |
| WO | 2014/045576 | 3/2014 |

*Primary Examiner* — Cassey D Bauer
(74) *Attorney, Agent, or Firm* — Pearne & Gordon LLP

(57) ABSTRACT

An enclosure includes an enclosure interior and an enclosure opening through which air passes from outside the enclosure into the enclosure interior. An evaporator located at the enclosure interior is positioned so that at least some of the air that passes through the enclosure opening flows in a direct and uninterrupted path to the evaporator. A shield within the enclosure interior is interposed between the enclosure opening and the evaporator and is positioned so as to deflect at least a part of the air flowing from that direct and uninterrupted path. The shield provides a site at which moisture contained within at least some of the air passing through the enclosure opening can collect. The enclosure can comprise the freezer compartment of a refrigerator, and the enclosure opening can be in fluid communication with an interior of a fresh food compartment of the refrigerator.

15 Claims, 4 Drawing Sheets

(56) References Cited

U.S. PATENT DOCUMENTS

| | | | | |
|---|---|---|---|---|
| 2011/0126571 | A1 | 6/2011 | Selin et al. | |
| 2011/0146054 | A1 | 6/2011 | Selin et al. | |
| 2011/0146336 | A1 | 6/2011 | Selin et al. | |
| 2011/0162403 | A1 | 7/2011 | Selin et al. | |
| 2011/0167858 | A1 | 7/2011 | Andersson et al. | |
| 2011/0179816 | A1 | 7/2011 | Andersson et al. | |
| 2014/0260366 | A1* | 9/2014 | Kuehl | F25D 17/06 62/89 |

* cited by examiner

EVAPORATOR SHIELDS

FIELD OF THE INVENTION

The present invention relates generally to evaporators and, more particularly, to evaporator shields that act to deflect and reroute the flow of air that is directed to the evaporators and provide a site at which moisture in that air can be collected, thereby dehumidifying the air.

BACKGROUND OF THE INVENTION

Evaporators that function to cool air that flows in contact with the evaporators have a variety of applications. In many instances, the air that is directed to the evaporators for cooling contains moisture that condenses to form frost and ice at the evaporators, thereby, among other undesirable consequences, compromising the efficient operation of the evaporators. For example, refrigeration appliances such as household refrigerators are routinely provided with evaporators that can serve to cool both the freezer compartments and the fresh food compartments of the refrigerators by cooling air delivered to the evaporators and supplying the cooled air to the freezer and fresh food compartments. Oftentimes, at least a portion of the air that is directed to the evaporators for cooling comprises air that is recirculated to the evaporators from the fresh food compartments of the refrigerators. Typically the recirculated air is at a temperature such that the air contains significant quantities of moisture that can be deposited at the evaporators as frost and ice. Heaters can be provided at the evaporators for intermittently defrosting the frost and ice that has accumulated at the evaporators. However, the heaters cannot in all circumstances maintain the evaporators frost- and ice-free to an extent required for the efficient operation of the evaporators because the amount of heat that can be applied by the heaters can be limited by other considerations.

BRIEF SUMMARY OF THE INVENTION

The following presents a simplified summary of the invention in order to provide a basic understanding of some aspects of the invention. The summary does not represent an extensive overview of the invention, nor is the summary intended to identify key or critical elements of the invention or delineate the scope of the invention. The sole purpose of the summary is to present certain concepts of the invention in a simplified form as a prelude to the description of the invention that is presented hereinafter.

According to one aspect of the invention, an assemblage can include an enclosure that can include an enclosure interior and an enclosure opening through which air passes from outside the enclosure into the enclosure interior. An evaporator can be located at the enclosure interior in a position with respect to the enclosure opening such that at least a part of the air that passes from outside the enclosure into the enclosure interior through the enclosure opening is oriented upon entry into the enclosure interior to flow in a direct and uninterrupted path to the evaporator. A shield can be located within the enclosure interior interposed between the enclosure opening and the evaporator. The shield can be positioned so as to deflect from the direct and interrupted path to the evaporator at least a portion of the at least a part of the air passing through the enclosure opening from outside the enclosure. The shield can have a temperature lower than the temperature of the at least a portion of the at least a part of the air passing through the enclosure opening, thereby providing a site at which at least a portion of the moisture contained within the at least a portion of the at least a part at of the air passing through the enclosure opening can collect, thereby dehumidifying the air.

According to another aspect, the evaporator can include an evaporator first boundary that is located in line with the direct and uninterrupted path of the air, an evaporator second boundary and an evaporator third boundary. The shield can be located at the evaporator first boundary and be configured to deflect the at least a portion of the at least a part of the air passing through the enclosure opening away from the direct and uninterrupted path in a direction generally towards the evaporator second boundary and towards the evaporator third boundary.

According to a further aspect, the shield can includes a first series of slatted openings that are in line with the direct and uninterrupted path and are configured to deflect from that path in a first direction, comprising the direction towards the evaporator second boundary, a first fraction of the at least a portion of the at least a part of the air passing through the enclosure openings. The shield also can include a second series of slatted openings that are in line with the direct and uninterrupted path and are configured to deflect in a second direction, comprising the direction towards the evaporator third boundary, a second fraction of the at least a portion of the at least a part of the air passing through the enclosure opening.

According to an additional aspect, the evaporator can include an evaporator first face that is spaced away from an enclosure first wall and the shield can include a shield back panel that is located between the evaporator first face and the enclosure first wall. The shield back panel can have a shield back panel first areal component that extends between the evaporator second boundary and the evaporator third boundary and a shield back panel second areal component that extends between the evaporator first boundary and an evaporator fourth boundary located opposite the evaporator first boundary. In a particular embodiment of this aspect, the shield back panel second areal component can include a shield back panel terminal edge that is nearer the evaporator first boundary than the evaporator fourth boundary and engages the enclosure first wall so as to form a shield back panel channel at the enclosure first wall.

According to yet another aspect, the shield can include a shield first end panel that is located at the evaporator second boundary and extends at an angle away from the first series of slatted openings, whereby at least a portion of air passing through the first series of slatted openings impinges at an interior surface of the shield first end panel. The shield also can include a shield second end panel that is located at the evaporator third boundary and extends at an angle from the second series of slatted openings, whereby at least a portion of air passing through the second series of slatted openings impinges at an interior surface of the shield second end panel. The shield first end panel, the shield second end panel and the shield back panel can comprise one or more panels that are configured to confine and direct to the evaporator at least a portion of the air that enters the enclosure through the enclosure opening.

According to yet a further aspect, the shield first end panel can include a shield first end panel terminal edge that is nearer the evaporator first boundary than the evaporator fourth boundary. In addition, the shield second end panel can include a shield second end panel terminal edge that is nearer the evaporator first boundary than the evaporator fourth boundary.

According to yet an additional aspect, the shield can include a shield back panel first passageway that is located between the shield first end panel and the shield back panel, whereby at least a portion of the air at the shield back panel channel passes through the shield back panel first passageway to the evaporator. The shield also can include a shield back panel second passageway that is located between the shield second end panel and the shield back panel, whereby at least a portion of the air at the shield back panel channel passes through the shield back panel second passageway to the evaporator.

According to still another aspect, the first series of slatted openings and the second series of slatted openings can be sufficiently narrow so that the air passing through the first series of slatted openings and the second series of slatted openings will be caused to deposit at the shield moisture contained in the air that forms frost and ice at the first series of slatted openings and the second series of slatted openings. At the same time, the first series of slatted openings and the second series of slatted openings can be sufficiently wide so that the buildup of frost and ice at the first series of slatted openings and the second series of slatted openings is not great enough to entirely block the flow of air through the first series of slatted openings and the second series of slatted openings between the occasions when one or more heaters at the enclosure interior are activated to defrost frost and ice formed at the shield.

According to still another aspect, the enclosure can comprise the freezer compartment of a refrigerator and the enclosure opening can be in fluid communication with an interior of a fresh food compartment of the refrigerator.

According to still a further aspect, an air handling unit can be located in the fresh food compartment and include at least one air ingress opening through which air from the fresh food compartment enters the air handling unit. The air handling unit also can include an air egress opening that is in fluid communication with the enclosure opening.

According to still an additional aspect, an evaporator shield can be configured to deflect air passing to an evaporator and provide a site at which moisture in the air can collect. The evaporator shield can include a shield base panel that can include a shield base panel first end, a shield base panel second end located opposite the shield base panel first end, a shield base panel lateral margin joined to the shield base panel first end and the shield base panel second end, and a shield base panel first side. A shield first end panel can be located at the shield base panel first end and extend away from the shield base panel first side. A shield second end panel can be located at the shield base panel second end and extend away from the shield base panel first side. A first series of slatted openings can be located at the shield base panel, the slats of which extend away from the shield base panel first side in the direction of the shield first end panel. A second series of slatted openings can be located at the shield base panel, the slats of which extend away from the shield base panel first side in the direction of the shield second end panel. A shield lateral panel can be joined to the shield base panel at the shield base panel lateral margin and extend away at an obtuse angle from the shield base panel first side between the shield first end panel and the shield second end panel. In this aspect, both in the case in which the shield lateral panel extends away at an obtuse angle from the shield base panel first side and in the case in which the shield lateral panel extends away from the shield base panel first side at other than an obtuse angle, a first passageway through the shield lateral panel can be located adjacent the shield first end panel and a second passageway through the shield lateral panel can be located adjacent the shield second end panel.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
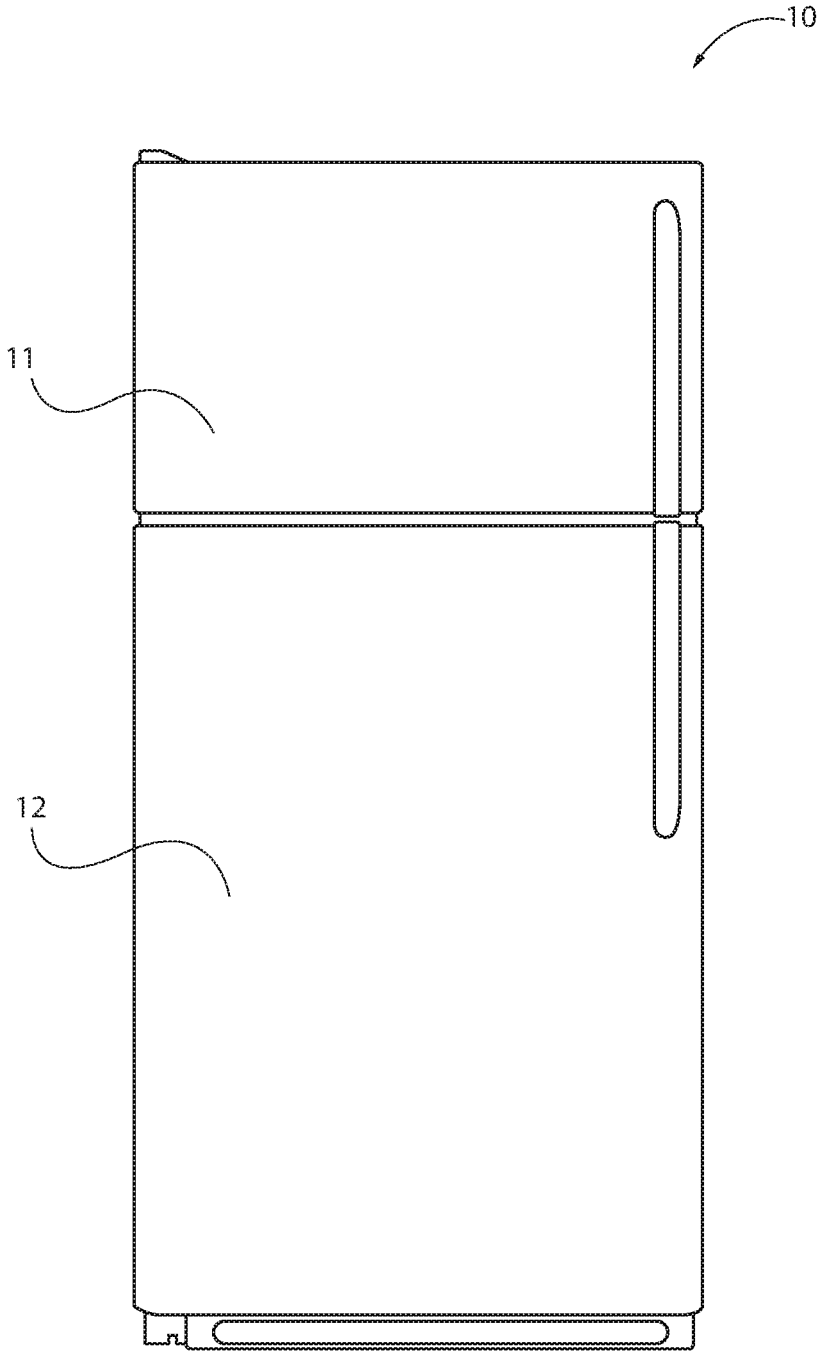
FIG. 1 is a front elevational view of an example of a household refrigerator at which an example of the present invention can be applied.

The present invention will now be described with reference to the drawings, wherein like reference numerals are used to refer to like elements throughout. It is to be appreciated that the various drawings are not necessarily drawn to scale from one figure to another or within a given figure. Also, the sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details.

Referring first to FIG. 1, an example of a refrigerator, indicated generally at 10, is shown at which an example of the present invention can be employed. The refrigerator 10 comprises a so-called top-mount refrigerator that includes a freezer compartment having a freezer compartment door 11 through which access can be had to the freezer compartment interior. The freezer compartment is located, essentially, directly above a fresh food compartment that includes a fresh food compartment door 12 through which access can be had to the fresh food compartment interior. In top-mount refrigerators, an evaporator that provides cold air to both the freezer compartment, at which a temperature is typically maintained well below the freezing point of water, and the fresh food compartment, at which a temperature is typically maintained somewhat above the freezing point of water, is located at the freezer compartment as is described in greater detail below.

Figure 2:
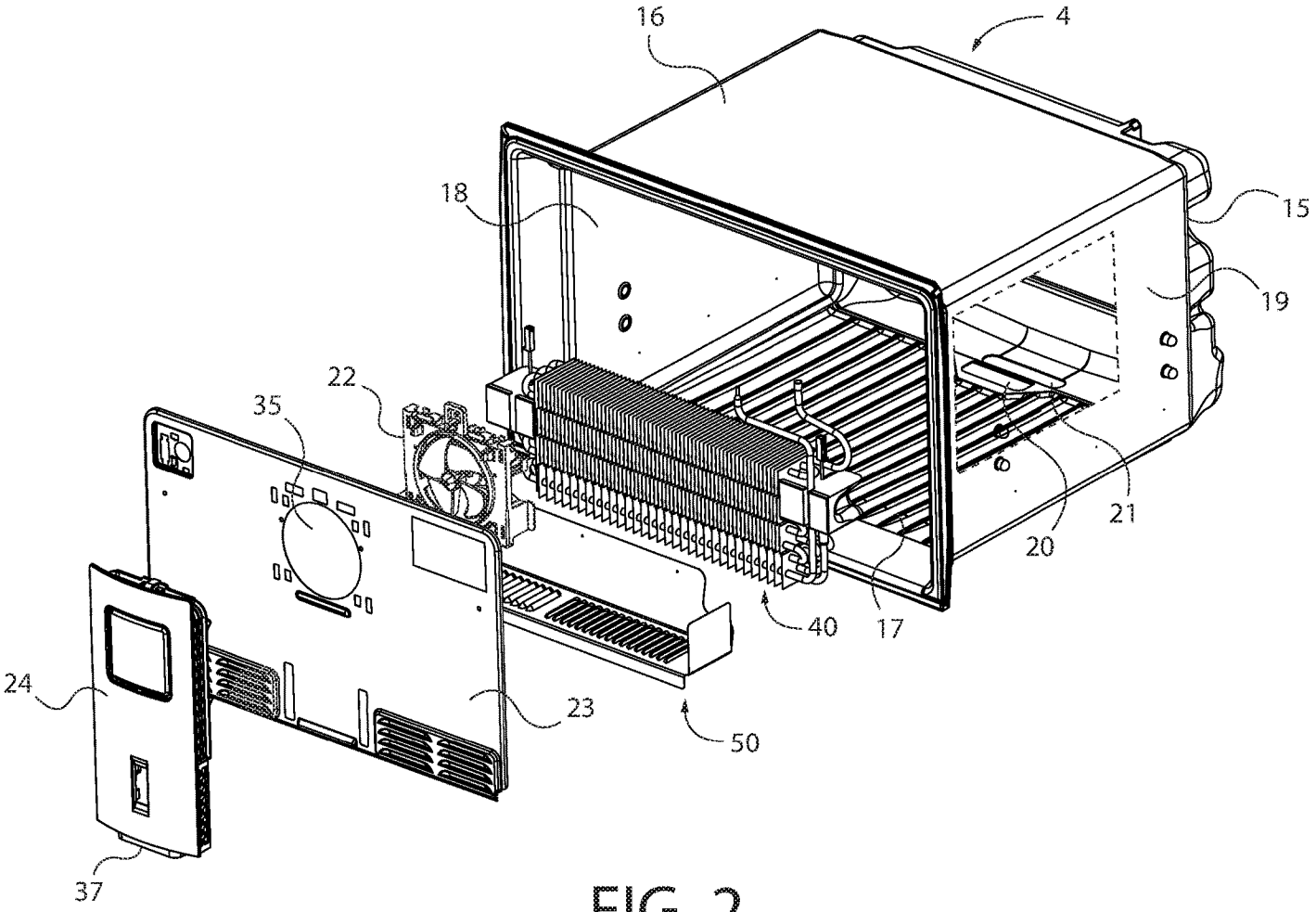
FIG. 2 is an exploded perspective view of an assemblage of components comprising an example of the present invention with a certain portion of one component broken away to show an interior portion of the component.
Figure 3:
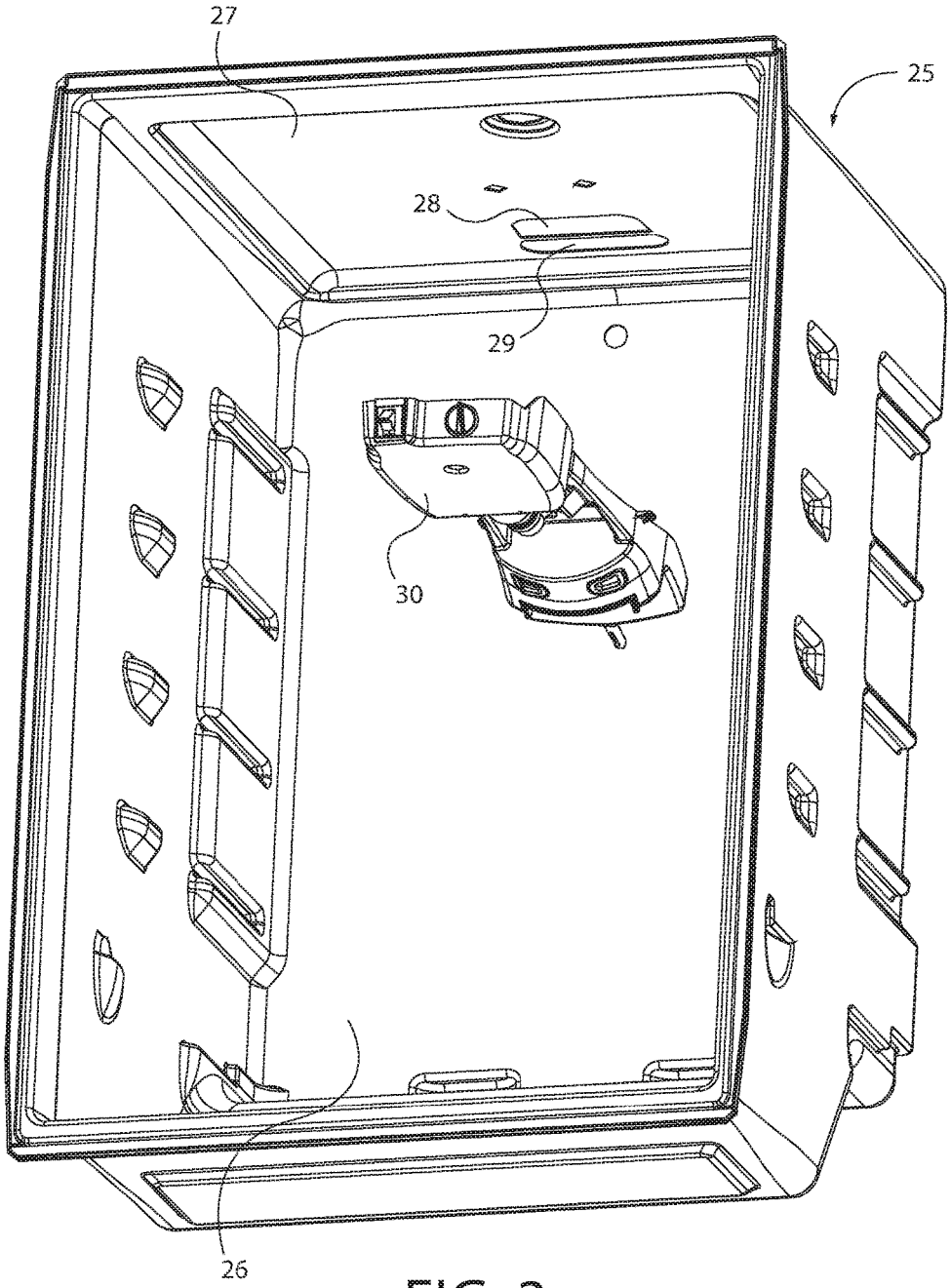
FIG. 3 is a perspective view of an example of an adjunct to the assemblage of FIG. 2.

Turning now to FIG. 2, there is shown an assemblage comprising an example of the present invention that includes a freezer compartment liner, indicated generally at 14. The freezer compartment liner 14 is located and held at the freezer compartment of the refrigerator 10 and comprises an enclosure having an enclosure interior comprising the interior of the freezer compartment liner 14. Additional elements of the assemblage are described below. Shown in FIG. 3 is a fresh food compartment liner, indicated generally at 25, that is located and held at the fresh food compartment of the refrigerator 10 and comprises an example of an adjunct to the assemblage of FIG. 2. Typically, the freezer compartment liner 14 and the fresh food compartment liner 25 are constructed of a rigid plastic material and are mounted within the outer shell or cabinet of the freezer compartment and the fresh food compartment, respectively, as is familiar to those having ordinary skill in the art.

As shown in the example of FIG. 2, the freezer compartment liner 14 includes a freezer liner back wall 15 comprising an enclosure first wall, a freezer liner upper wall 16 comprising an enclosure second wall, a freezer liner bottom wall 17 comprising an enclosure third wall, a freezer liner first side wall 18 comprising an enclosure fourth wall and a freezer liner second side wall 19 comprising an enclosure fifth wall. A freezer liner bottom wall first opening 20, and a freezer liner bottom wall second opening 21 comprising an enclosure opening, are located at the freezer liner bottom wall 17 adjacent the intersection of the freezer liner bottom wall 17 and the freezer liner back wall 15. And as can be seen in FIG. 2, components of the assemblage that comprise an example of the invention and that can be located within the freezer compartment liner 14 include an evaporator, indicated generally at 40, an evaporator shield, indicated generally at 50, a fan 22, an isolating panel 23 and a freezer compartment air tower 24. The evaporator 40 is mounted adjacent the freezer liner bottom wall 17 above the freezer liner bottom wall second opening 21, and the evaporator shield 50 is located directly beneath the evaporator 40 between the bottom of the evaporator and freezer liner bottom wall second opening 21 as is described in greater detail below. The fan 22 is mounted at an isolating panel opening 35 at the side of the isolating panel 23 that faces the evaporator 40, and the freezer compartment air tower 24 is mounted at the isolating panel 23 in fluid communication with the isolating panel opening 35 at the side of the isolating panel that faces away from the from the evaporator 40. The freezer compartment air tower 24 includes a freezer air tower opening 37 at the base of the air tower that is in fluid communication with the freezer liner bottom wall first opening 20. The isolating panel 23 serves to separate the evaporator 40, the evaporator shield 50 and the fan 22 from the remainder of the interior of the freezer compartment liner 14, and that remainder of the interior of the freezer compartment liner can include, for example, wire shelves, baskets, an ice maker and other components that can be advantageously maintained at the interior of the freezer compartment liner 14 as known to those having ordinary skill in the art.

As shown in FIG. 3, the fresh food compartment liner 25 includes a fresh food liner back wall 26 and a fresh food liner top wall 27. A fresh food liner top wall first opening 28 and a fresh food liner top wall second opening 29 are located at the fresh food liner top wall 27 adjacent the intersection of the fresh food liner top wall 27 and the fresh food liner back wall 26. The fresh food liner top wall first opening 28 is in fluid communication with the freezer liner bottom wall first opening 20 and the fresh food liner top wall second opening 29 is in fluid communication with the freezer liner bottom wall second opening 21. That fluid communication can be established, for example, by abutting the freezer liner bottom wall first opening 20 with the fresh food liner top wall first opening 28 and abutting the freezer liner bottom wall second opening 21 with the fresh food liner top wall second opening 29. Alternatively, duct work can be provided between the freezer liner bottom wall first opening 20 and the fresh food liner top wall first opening 28 and between the freezer liner bottom wall second opening 21 and the fresh food liner top wall second opening 29.

A component that can be installed at the fresh food liner top wall 27 comprises an air handling unit 30 that both delivers cold air from the evaporator 40 to the interior of the fresh food compartment liner 25 and returns spent air from the interior of the fresh food compartment liner 25 to the evaporator 40. In this respect, the air handling unit 30 can include: an air ingress (not shown) that is in fluid communication with the freezer air tower opening 37 through the fresh food liner top wall first opening 28 and the freezer liner bottom wall first opening 20; and air egresses (not shown) that are in fluid communication with that air ingress, whereby cold air from the evaporator 40 is delivered to the interior of the fresh food compartment liner 25. The air handling unit 30 also can include: an air egress (not shown) that is in fluid communication with the interior of the freezer compartment liner 14, at the evaporator 40, through the fresh food liner top wall second opening 29 and the freezer liner bottom wall second opening 21; and air ingresses (not shown) that are in fluid communication with that air egress, whereby spent air from the interior of the fresh food compartment liner 25 is delivered to the evaporator 40. The fresh food compartment liner 25 also can include, for example, shelves, drawers and other components that can be advantageously maintained within the fresh food compartment liner, particularly for the storage of perishable items, as is known to those skilled in the art.

The operation of the refrigerator 10 includes the circulation of cold air from the evaporator to both the interior of the freezer compartment liner 14 and the interior of the fresh food compartment liner 25 and the recirculation of air from the interior of the fresh food compartment liner 25 to the evaporator 40 for renewed cooling and recirculation to the interior of the fresh food compartment liner 25. This circulation and recirculation is accomplished by means of several of the components described above. Specifically, with respect to the circulation of cold air to the freezer compartment, cold air is generated at the evaporator 40 and a first portion of that cold air is driven by the fan 22 through the isolating panel opening 35 into and out of the freezer compartment air tower 24 into the interior of the freezer compartment liner 14 at which items are stored. The freezer compartment air tower 24 can have appropriate egresses through which cold air exits the freezer compartment air tower into the interior of the freezer compartment liner 14. A second portion of the cold air is directed at the freezer compartment air tower 24 through the freezer air tower opening 37 and through the freezer liner bottom wall first opening 20 and the fresh food liner top wall first opening 28 into the air handling unit 30 through the air handling unit ingress located at the fresh food liner top wall first opening 28. From there, the cold air flows into the interior of the fresh food compartment liner 25 through egresses in the air handling unit 30. As this delivery of cold air to the interior of the fresh food compartment liner 25 continues, air that has previously been introduced into the interior of the fresh food compartment liner 25 enters the ingresses at the air handling unit 30 and flows through the air handling unit air egress that is in fluid communication with the fresh food liner top wall second opening 29 and the freezer liner bottom wall second opening 21 to the evaporator 40.

Appropriate ducting is provided within the air handling unit 30 to isolate the cold air flowing to the interior of the fresh food compartment liner 25 from the recirculated air returning from the interior of the fresh food compartment liner 25 to the evaporator 40 as is known to those having ordinary skill in the art. Also as is understood by those having ordinary skill in the art, appropriate ducting is provided within the freezer compartment air tower 24 to segregate the cold air delivered to the interior of the freezer compartment liner 14 from the cold air that is passed to the interior of the fresh food compartment liner 25 through the air handling unit 30.

The present invention, as applied to the example of a refrigerator, need not include an air circulation arrangement inclusive of the equipment described above. Other means and approaches can be employed to circulate the air within the refrigerator 10. In any case, however, the air circulation arrangement will involve the delivery to an evaporator of air that contains moisture and is at a temperature greater than the temperature to which the air is cooled at the evaporator. Air of this character, when it enters a freezer compartment, such as the interior of the freezer compartment liner 14, and is cooled, will deposit at least some of the moisture it contains at the freezer compartment interior to form frost and ice. The formation of the frost and ice typically takes place at the evaporator, and the formation can be so great as to compromise the efficient operation of the evaporator even to the extent of shutting down the evaporator.

Figure 4:
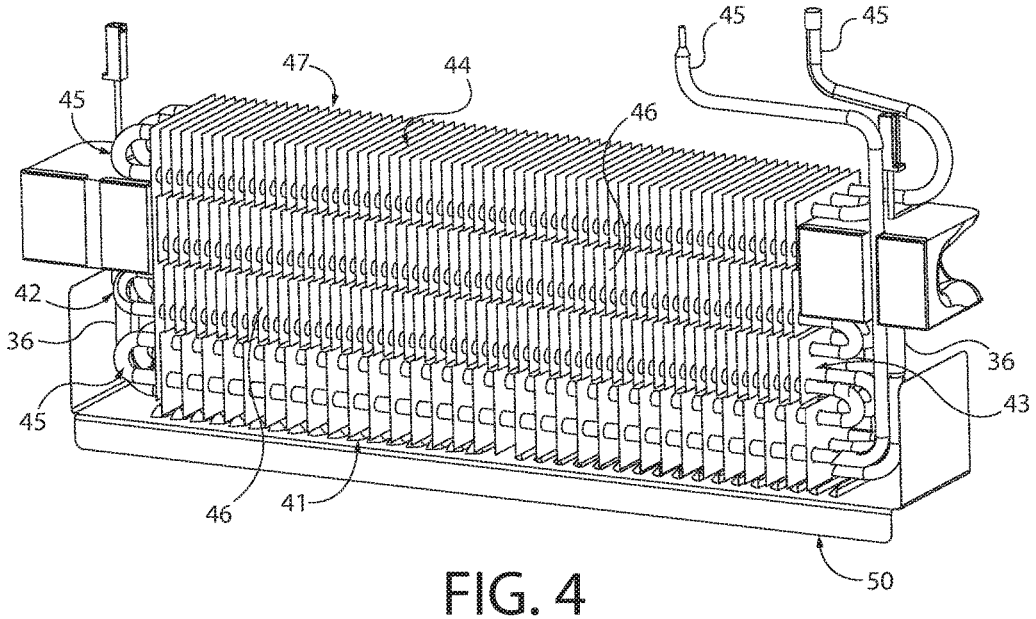
FIG. 4 is a perspective view of certain components of the assemblage of FIG. 2.

In most cases the problem is addressed by providing one or more heaters such as the heaters 36 at the evaporator 40, as can be seen in FIG. 4. As is familiar to those having ordinary skill in the art, a system that controls the operation of the heaters 36 is programmed in selected ways to intermittently activate the heaters in an appropriate manner to thaw the frost and ice that has formed at the interior of the freezer compartment liner 14 without undesirably compromising the cooling effect produced by the evaporator 40. However, circumstances can exist such that the formation of frost and ice is so great that whatever heaters are provided are inadequate to maintain the interior of the freezer compartment liner, particularly at the evaporator, sufficiently free of frost and ice to prevent the frost and ice from eventually building up to the point that the buildup overwhelms the evaporator and generally overtakes the interior of the freezer compartment liner.

Such a circumstance can exist, for example, at a refrigerator constructed as shown in the example of the drawings wherein the evaporator 40 is located with respect to the freezer liner bottom wall second opening 21 such that at least a part of the air that enters the interior of the freezer compartment liner 14 through the freezer liner bottom wall second opening 21 is oriented upon entry into the interior of the freezer compartment liner 14 to flow in a direct and uninterrupted path to the evaporator 40. Air that flows in such a path is referred to from time to time herein as "oriented air." In the case of the air that enters the interior of the freezer compartment liner 14 from the interior of the fresh food compartment liner 25, that air, having become warmer at least in part as a result of its contact with the items stored at the interior of the fresh food compartment liner, will typically be at a temperature well above the temperature at the interior of the freezer compartment liner 14 and can contain considerable moisture. As a result, the air, as it enters the interior of the freezer compartment liner 14 through the freezer liner bottom wall second opening 21, and particularly the part of the air that is oriented upon entry to flow in a direct and interrupted path to the evaporator 40, can deposit copious amounts of frost and ice at the evaporator.

The evaporator 40 in the example of the drawings, as best seen in FIG. 4, includes cooling coils, indicated generally at 45, and heat-transfer fins, indicated generally at 46, but the invention encompasses other evaporator constructs as well as will be evident from the description of the invention that follows. The evaporator includes an evaporator first boundary, which in the example comprises an evaporator lower boundary, indicated generally at 41; an evaporator second boundary, which in the example comprises an evaporator first side boundary, indicated generally at 42; an evaporator third boundary, which in the example comprises an evaporator second side boundary, indicated generally at 43; and an evaporator fourth boundary, which in the example comprises an evaporator upper boundary, indicated generally at 44, located opposite the evaporator lower boundary 41. The evaporator 40 also includes an evaporator first face, indicated generally at 47, that is spaced away from an enclosure first wall that comprises the freezer liner back wall 15. The evaporator lower boundary 41 is located substantially in line with the directed and uninterrupted path with which at least a part of the air that passes through the freezer liner bottom wall second opening 21 is oriented upon entry into the interior of the freezer compartment liner 14.

According to the present invention, a shield, and more particularly an evaporator shield, is provided that can mitigate the deposition of frost and ice at the evaporator 40. Specifically, the evaporator shield 50, which comprises an example of a shield that can be employed, is located within the enclosure interior, comprising the interior of the freezer compartment liner 14 in the example of the drawings, and is interposed between the freezer liner bottom wall second opening 21 and the evaporator 40. The evaporator shield 50 is positioned so as to deflect from the direct and uninterrupted path to the evaporator 40 at least a portion of the oriented air. This feature of the evaporator shield 50, together with the fact that the evaporator shield 50 will be at a temperature substantially lower than the temperature of the air entering the interior of the freezer compartment liner 14 through the freezer liner bottom wall second opening 21, will reduce the amount of frost and ice that can be collected at the evaporator 40. Thus, the evaporator shield 50 provides a site at which at least a portion of the moisture contained within the air entering the interior of the freezer compartment liner 14 through the freezer liner bottom wall second opening 21 can collect. The overall effect of the evaporator shield 50, therefore, is to deal with the moisture in the air entering the freezer liner bottom wall second opening 21 in a manner such that the buildup of frost and ice that takes place at the interior of the freezer compartment liner 14 can be adequately handled without excessively operating the heaters 36.

The present invention encompasses evaporator shield structures of any kind that both at least partially deflect air from passing directly and uninterruptedly to an evaporator and provide a site at which moisture in the air can be collected, thereby, in effect, dehumidifying the air. The evaporator shield 50 comprises one example of such a shield and is shown in greater detail in FIG. 5.

Figure 5:
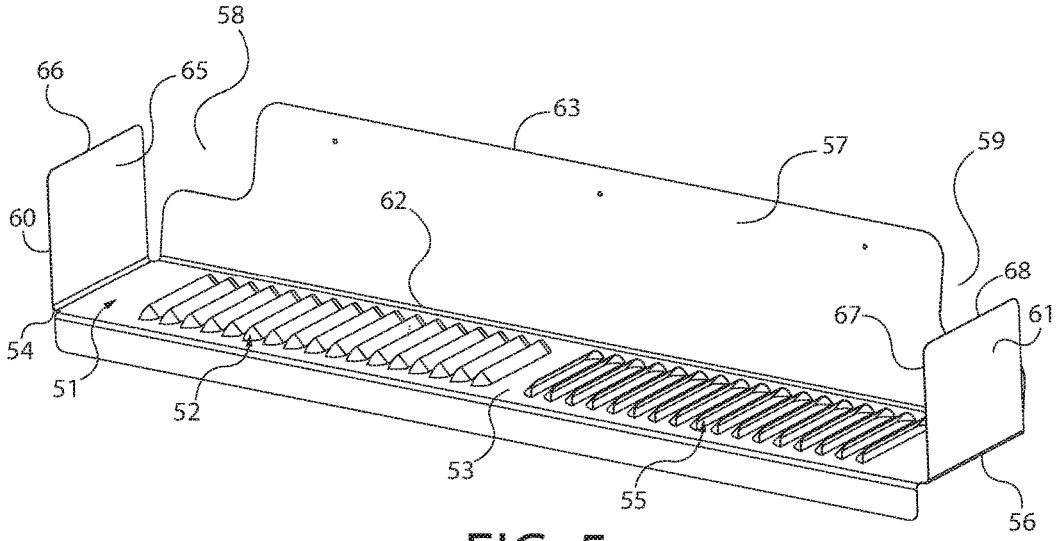
FIG. 5 is a perspective view of one of the components of FIG. 4.

In the example of FIG. 5, the evaporator shield 50 includes a shield base panel, indicated generally at 51, comprising a shield forward panel, that faces the freezer liner bottom wall second opening 21. The shield base panel 51 includes a shield first series of slatted openings, indicated generally at 52, that are in line with the direct and uninterrupted path to the evaporator 40 of the oriented air. The shield first series of slatted openings 52 are configured to deflect from that direct and uninterrupted path in a first direction a first fraction of the oriented air. Specifically, the individual slats of the shield first series of slatted openings 52, comprising a type of louvered structure, are inclined at a shield base panel first side 53 away from the shield base panel first side in a direction towards a shield base panel first end 54. The shield base panel 51 also includes a shield second series of slatted openings, indicated generally at 55, that are in line with the direct and uninterrupted path to the evaporator 40 of the oriented air. The shield second series of slatted openings 55 are configured to deflect from that direct and uninterrupted path in a second direction a second fraction of the oriented air. Specifically, the individual slats of the shield second series of slatted openings 55, also comprising a type of louvered structure, are inclined at the shield base panel first side 53 away from the shield base panel first side in a direction towards a shield base panel second end 56.

The evaporator shield 50 also includes one or more panels that are configured to confine and direct to the evaporator 40 air that enters the interior of the freezer compartment liner 14 through the freezer liner bottom wall second opening 21, including at least a portion of the air that is deflected through the shield first series of slatted openings 52 and the shield second series of slatted openings 55. Specifically, the evaporator shield 50 includes a shield back panel 57, comprising a shield lateral panel, a shield first end panel 60 and a shield second end panel 61. The shield back panel 57 is joined to the shield base panel 51 at a shield base panel lateral margin 62 and extends at the shield base panel first side 53 both in a direction towards the shield base panel first end 54 and in a direction towards the shield base panel second end 56, so as to have a lateral or first areal component between the shield base panel first end 54 and the shield base panel second end 56. The shield back panel 57 also extends at the shield base panel lateral margin 62 in a direction away from the shield base panel first side 53 to a shield back panel terminal edge 63, so as to have a medial or second areal component between the shield base panel lateral margin 62 and the shield back panel terminal edge 63. The shield back panel 57 can be inclined from the vertical in a direction away from the shield base panel 51. That is, the shield back panel 57 can extend away at an obtuse angle from the shield base panel first side 53. The lateral component of shield back panel 57 includes a shield back panel first passageway 58 adjacent the shield base panel first end 54 and a shield back panel second passageway 59 adjacent the shield base panel second end 56. These passageways allow for the movement of air through the shield back panel 57 as described in greater detail below.

The shield first end panel 60 is joined to the shield base panel 51 at the shield base panel first end 54, includes a shield first end panel interior surface 65 and extends in a direction away from the shield base panel 51 at the shield base panel first side 53 to a shield first end panel terminal edge 66. The shield second end panel 61 is joined to the shield base panel 51 at the shield base panel second end 56, includes a shield second end panel interior surface 67 and extends in a direction away from the shield base panel 51 at the shield base panel first side 53 to a shield second end panel terminal edge 68. The manner in which the shield back panel 57, the shield first end panel 60 and the shield second end panel 61 confine and direct to the evaporator 40 air that enters the interior of the freezer compartment liner 14 through the freezer liner bottom wall second opening 21, including at least a portion of the air that is deflected through the shield first series of slatted openings 52 and the shield second series of slatted openings 55 is described in greater detail below.

The spatial relationships among the evaporator 40, the evaporator shield 50, the freezer liner bottom wall first opening 20 and the freezer liner back wall 15 can best be seen from a consideration of FIGS. 2 and 4. In this regard, it is first noted that in the example of the drawings, the shield first end panel 60 is located at the evaporator first side boundary 42, and the shield first end panel terminal edge 66 is nearer the evaporator lower boundary 41 than the evaporator upper boundary 44. The shield second end panel 61 is located at the evaporator second side boundary 43, and the shield second end panel terminal edge 68 is nearer the evaporator lower boundary 41 than the evaporator upper boundary 44. These arrangements of the shield first end panel 60 and the shield second end panel 61 protect the freezer liner first side wall 18 and the freezer liner second side wall 19, respectively, from the heat generated at the heaters 36. Similarly, the shield base panel 51 protects the freezer liner bottom wall 17 from the heat generated at the heaters 36; and the shield back panel 57 protects the freezer liner back wall 15 from that heat.

The evaporator shield 50 is located at the evaporator lower boundary 41 and is configured to deflect at least a portion of the oriented air away from the direct and uninterrupted path in a direction towards the evaporator first side boundary 42 and in a direction towards the evaporator second side boundary 43. Specifically, the shield first series of slatted openings 52 are configured to deflect in the direction towards the evaporator first side boundary 42 a first fraction of the at least a portion of the oriented air, and the shield second series of slatted openings 55 are configured to deflect in the direction towards the evaporator second side boundary 43 a second fraction of the at least a portion of the oriented air. As can be seen from FIG. 2 and FIG. 4, each of the air that passes through the portion of the first series of slatted openings 52 that are located more centrally of the shield base panel 51 and the air that passes through the shield second series of slatted openings 55 that are located more centrally of the shield base panel 51 is deflected to an extent such that the air moves to the evaporator lower boundary 41. At the same time, the portion of the air that passes through those slatted openings of the shield first series of slatted openings 52 that are located nearer the shield base panel first end 54, because of the inclination it assumes in passing through those openings, will impinge at the shield first end panel interior surface 65 and be reflected to the evaporator 40. Similarly, the portion of the air that passes through those slatted openings of the shield second series of slatted openings 55 that are located nearer the shield base panel second end 56 will impinge at the shield second end panel interior surface 67 and be reflected to the evaporator 40.

As indicated, the evaporator first face 47 is spaced away from the freezer liner back wall 15. The shield back panel 57 is located between the evaporator first face 47 and the freezer liner back wall 15 with the shield back panel terminal edge 63 being nearer the evaporator lower boundary 41 than the evaporator upper boundary 44. The shield back panel first areal component extends between the evaporator first side boundary 42 and the evaporator second side boundary 43, and the shield back panel second areal component extends between the evaporator lower boundary 41 and the evaporator upper boundary 44. The inclination from the vertical away from the shield base panel 51 that the shield back panel 57 can possess is sufficient for the shield back panel terminal edge 63 to engage the freezer liner back wall 15 and form a shield back panel channel and limit the ability of air to pass beyond the shield back panel terminal edge 63. In this arrangement, air that enters the freezer compartment liner 14 through the freezer liner bottom wall second opening 21 and moves upwardly behind the shield back panel 57 into the shield back panel channel, after dropping out at least a portion of its moisture at whatever surfaces of the evaporator shield 50 the air contacts, will pass through the shield back panel first passageway 58 and the shield back panel second passageway 59 to the evaporator 40.

In one embodiment of the invention, the shield first series of slatted openings 52 and the shield second series of slatted openings 55 are sufficiently narrow so that the air passing through the shield first series of slatted openings and the shield second series of slatted openings 55 will not pass through those openings without being caused to deposit at the evaporator shield 50 moisture contained in the air that forms frost and ice at the shield first series of slatted openings 52 and the shield second series of slatted openings 55. At the same time, the shield first series of slatted openings 52 and the shield second series of slatted openings 55 are sufficiently wide so that the buildup of frost and ice at the first series of slatted openings and the second series of slatted openings is not great enough to entirely block the flow of air through the shield first series of slatted openings 52 and the shield second series of slatted openings 55 between the occasions when one or more heaters at the enclosure interior are activated to defrost frost and ice formed at the evaporator shield 50. However, it is not required that the shield first series of slatted openings 52 and the shield second series of slatted openings 55 be sufficiently wide so that the buildup of frost and ice at those slatted openings is not great enough to entirely block the flow of air therethrough. Even when the slatted openings are blocked with frost and ice, the presence of the evaporator shield 50 presents surfaces that the incoming air can contact and drop at least a portion of its moisture before passing to the evaporator 40.

The invention has been described herein above using specific examples; however, it will be understood by those skilled in the art that various alternatives may be used and equivalents may be substituted for elements or steps described herein without deviating from the scope of the invention. Modifications may be necessary to adapt the invention to a particular situation or to a particular need without departing from the scope of the invention. For example, the invention can be applied to other types of refrigeration appliances including so-called "bottom-mount" refrigerators in which the freezer compartment is located beneath the fresh food compartment and an opening that supplies air from the fresh food compartment interior to the freezer compartment interior is located at the base of the fresh food compartment interior. The invention also can be employed at refrigerators where the freezer compartment and the fresh food compartment are arranged side-by-side. Additionally, the invention can be applied to evaporator systems other than evaporator systems employed at refrigeration appliances. For example, the invention can be applied to air-conditioning systems of various types where it can be useful to provide an evaporator shield to prevent the undesirable build-up of frost and ice at the air-conditioning systems' evaporators. Thus, it is intended that the invention not be limited to the particular example shown in the drawings and described above, but that the claims be given their broadest interpretation to cover all embodiments, literal or equivalent, encompassed by the claims.

What is claimed is:

1. An assemblage including:

an enclosure including an enclosure interior and an enclosure opening through which air passes from outside the enclosure into the enclosure interior;

an evaporator located at the enclosure interior, the evaporator being located with respect to the enclosure opening such that at least a part of the air that passes from outside the enclosure into the enclosure interior through the enclosure opening is oriented upon entry into the enclosure interior to flow in a direct and uninterrupted path to the evaporator; and a shield located within the enclosure interior and interposed between the enclosure opening and the evaporator, the shield being positioned so as to deflect from the direct and uninterrupted path to the evaporator at least a portion of the at least a part of the air passing through the enclosure opening from outside the enclosure, the shield having a temperature lower than the temperature of the at least a portion of the at least a part of the air passing through the enclosure opening, thereby providing a site at which at least a portion of the moisture contained within the at least a portion of the at least a part of the air passing through the enclosure opening can collect, a first series of slatted openings that are in line with the direct and uninterrupted path with which at least a part of the air that passes through the enclosure opening is oriented upon entry into the enclosure and are configured to deflect from that direct and uninterrupted path in a first direction a first fraction of the at least a portion of the at least a part of the air passing through the enclosure opening; and a second series of slatted openings that are in line with the direct and uninterrupted path with which at least a part of the air that passes through the enclosure opening is oriented upon entry into the enclosure and are configured to deflect from that direct and uninterrupted path in a second direction a second fraction of the at least a portion of the at least a part of the air passing through the enclosure opening.

2. The assemblage of claim 1 wherein:

the enclosure comprises the freezer compartment of a refrigerator; and the enclosure opening is in fluid communication with an interior of a fresh food compartment of the refrigerator.

3. The assemblage of claim 2 including an air handling unit located in the fresh food compartment, the air handling unit including:

at least one air ingress opening through which air from the fresh food compartment enters the air handling unit; and an air egress opening that is in fluid communication with the enclosure opening.

4. The assemblage of claim 1 wherein the shield includes one or more panels that are configured to confine and direct to the evaporator at least a portion of the air that enters the enclosure though the enclosure opening.

5. The assemblage of claim 4 wherein the first series of slatted openings and the second series of slatted openings are sufficiently narrow so that the air passing through the first series of slatted openings and the second series of slatted openings will be caused to deposit at the shield moisture contained in the air that forms frost and ice at the first series of slatted openings and the second series of slatted openings and sufficiently wide so that the buildup of frost and ice at the first series of slatted openings and the second series of slatted openings is not great enough to entirely block the flow of air through the first series of slatted openings and the second series of slatted openings between the occasions when one or more heaters at the enclosure interior are activated to defrost frost and ice formed at the shield.

6. The assemblage of claim 4 wherein:

the enclosure comprises the freezer compartment of a refrigerator; and the enclosure opening is in fluid communication with an interior of a fresh food compartment of the refrigerator.

7. An assemblage including:

an enclosure including an enclosure interior and an enclosure opening through which air passes from outside the enclosure into the enclosure interior;

an evaporator located at the enclosure interior, the evaporator being located with respect to the enclosure opening such that at least a part of the air that passes from outside the enclosure into the enclosure interior through the enclosure opening is oriented upon entry into the enclosure interior to flow in a direct and uninterrupted path to the evaporator; and a shield located within the enclosure interior and interposed between the enclosure opening and the evaporator, the shield being positioned so as to deflect from the direct and uninterrupted path to the evaporator at least a portion of the at least a part of the air passing through the enclosure opening from outside the enclosure, the shield having a temperature lower than the temperature of the at least a portion of the at least a part of the air passing through the enclosure opening, thereby providing a site at which at least a portion of the moisture contained within the at least a portion of the at least a part of the air passing through the enclosure opening can collect, the evaporator includes an evaporator first boundary located in line with the direct and uninterrupted path with which at least a part of the air that passes through the enclosure opening is oriented upon entry into the enclosure through the enclosure opening, an evaporator second boundary and an evaporator third boundary; and the shield is located at the evaporator first boundary and is configured to deflect the at least a portion of the at least a part of the air passing through the enclosure opening away from the direct and uninterrupted path in a direction towards the evaporator second boundary and towards the evaporator third boundary, wherein the shield includes:

a first series of slatted openings configured to deflect in the direction towards the evaporator second boundary a first fraction of the at least a portion of the at least a part of the air passing through the enclosure opening; and a second series of slatted openings configured to deflect in the direction towards the evaporator third boundary a second fraction of the at least a portion of the at least a part of the air passing through the enclosure opening.

8. The assemblage of claim 7 wherein:

the enclosure comprises the freezer compartment of a refrigerator; and the enclosure opening is in fluid communication with an interior of a fresh food compartment of the refrigerator.

9. The assemblage of claim 7 wherein:

the evaporator includes an evaporator first face that is spaced away from an enclosure first wall; and the shield includes a shield back panel that is located between the evaporator first face and the enclosure first wall, the shield back panel having a shield back panel first areal component that extends between the evaporator second boundary and the evaporator third boundary and a shield back panel second areal component that extends between the evaporator first boundary and an evaporator fourth boundary located opposite to the evaporator first boundary.

10. The assemblage of claim 9 wherein the shield back panel second areal component includes a shield back panel terminal edge that is nearer the evaporator first boundary than the evaporator fourth boundary and engages the enclosure first wall so as to form a shield back panel channel at the enclosure first wall.

11. The assemblage of claim 10 wherein:

the enclosure comprises the freezer compartment of a refrigerator; and the enclosure opening is in fluid communication with an interior of a fresh food compartment of the refrigerator.

12. The assemblage of claim 10 wherein the shield includes:

a shield first end panel that is located at the evaporator second boundary and extends at an angle away from the first series of slatted openings, whereby at least a portion of air passing through the first series of slatted openings impinges at an interior surface of the shield first end panel; and a shield second end panel that is located at the evaporator third boundary and extends at an angle away from the second series of slatted openings, whereby at least a portion of air passing through the second series of slatted openings impinges at an interior surface of the shield second end panel.

13. The assemblage of claim 12 wherein:

the shield first end panel includes a shield first end panel terminal edge that is nearer the evaporator first boundary than the evaporator fourth boundary; and the shield second end panel includes a shield second end panel terminal edge that is nearer the evaporator first boundary than the evaporator fourth boundary.

14. The assemblage of claim 13 including:

a shield back panel first passageway located between the shield first end panel and the shield back panel, whereby at least a portion of the air at the shield back panel channel passes through the shield back panel first passageway to the evaporator; and a shield back panel second passageway located between the shield second end panel and the shield back panel, whereby at least a portion of the air at the shield back panel channel passes through the shield back panel second passageway to the evaporator.

15. The assemblage of claim 14 wherein:

the enclosure comprises the freezer compartment of a refrigerator; and the enclosure opening is in fluid communication with an interior of a fresh food compartment of the refrigerator.

* * * * *